US006244224B1

(12) United States Patent
Witter

(10) Patent No.: US 6,244,224 B1
(45) Date of Patent: Jun. 12, 2001

(54) HEATING SYSTEM FOR TANKS FOR STORING LIQUID PRODUCTS

(75) Inventor: Aldyr Witter, deceased, late of Sao Leopoldo (BR), by Roger Vieira Witter, legal representative

(73) Assignee: Petroleo Brasileiro S.A. (BR)

( * ) Notice: Subject to any disclaimer, the term of this patent is extended or adjusted under 35 U.S.C. 154(b) by 0 days.

(21) Appl. No.: 09/009,939

(22) Filed: Jan. 21, 1998

(Under 37 CFR 1.47)

(30) Foreign Application Priority Data

Jan. 21, 1997 (BR) ..... 9700726

(51) Int. Cl.[7] ..... F22B 15/00

(52) U.S. Cl. ..... 122/235.14; 122/15.1; 165/56; 126/378

(58) Field of Search ..... 432/74, 192, 238; 122/17, 235.14, 15.1; 165/53, 56, 71; 126/376, 377, 378

(56) References Cited

U.S. PATENT DOCUMENTS

| | | | | |
|---|---|---|---|---|
| 3,685,508 | * | 8/1972 | Heilmann | 126/378 |
| 3,858,861 | * | 1/1975 | Jernigan | 432/238 |
| 3,944,113 | * | 3/1976 | Heisterberg | 220/219 |
| 4,480,370 | * | 11/1984 | Loevinger | 126/378 |
| 5,265,651 | * | 11/1993 | Perkins et al. | 220/219 |
| 5,676,039 | * | 10/1997 | Wedding et al. | 99/276 |
| 5,788,152 | * | 8/1998 | Alsberg | 165/56 |

FOREIGN PATENT DOCUMENTS 25 34 380 2/1977 (DE) .

* cited by examiner

*Primary Examiner*—Denise L. Ferensic
*Assistant Examiner*—Gregory A. Wilson
(74) *Attorney, Agent, or Firm*—Nixon & Vanderhye PC

(57) ABSTRACT

The system uses principal radial tubes 4 which connect an inner, central arc 3 to an outer arc 2. A plurality of branches 5 emerge from these tubes 4 and then assume a radial geometry, forming secondary radial tubes which extend as far as the said outer arc 2. The system rests freely on the bottom of the tank.

12 Claims, 3 Drawing Sheets

HEATING SYSTEM FOR TANKS FOR STORING LIQUID PRODUCTS

FIELD OF THE INVENTION

The present invention relates to improved heating for liquid products, particularly petroleum and its derivatives, and aims to facilitate the draining-off of undesirable materials (dense residues, sludges, water, sand, etc.) which normally accumulate in the bottom of liquid storage tanks.

BACKGROUND OF THE INVENTION

It is known to provide a floating roof on a tank for containing relatively volatile liquids, in order to avoid the formation of a gas space in the tank. When the floating roof of such a tank for storing liquid products is low, it is not possible to use the customary systems normally used for heating liquid products in general; these basically depend on a variety of factors, such as the type of product, the amount stored, the temperature to be reached, and the heating time.

The present invention aims to provide tanks with low floating roofs, such as those described in International Application PCT/BR97/00022, with an individual heating system which can be used for such low operating heights, but which can also be used for conventional tanks.

PRIOR ART

Storage tanks are widely used in the petroleum industry and are essential to the functioning of an operational facility. They may be intended, for example, for storing crude oil, intermediate products and final products.

The sources of heat used include heated liquids, pressurized vapours, electrical energy or other less conventional sources.

Coils through which hot fluid passes are amongst the most common ways in which to heat tanks. In normal use, they are generally at a distance of 0.80 m from the level of the tank floor. There is considerable wasted space. Use is also made of laterally mounted heat exchangers.

Our International Application PCT/BR97/00022 relates to a new type of tank floor for which the present heating system is particularly suitable. It proposes the use of a floor whose centre is located at a level which is below the level of the edges. The residues which are to be drained off concentrate in the central region of the bottom of the tank.

With the installation of this new type of floor, because of the better draining-off of the undesirable liquids, the floating roof of the tank is able to descend to a position which is much closer to the floor than was previously attained. Consequently, a new problem arises in that, if the product has to be heated in a tank with a configuration of this type, it is necessary to have a heating system which can be contained in a small space (minimum operational height), which may be as little as 10 cm in height. A heating system of this type is not known from the prior art, however.

The minimum operational height is the minimum height above the floor of the tank, which the floating roof has to maintain during operation. In current storage tanks, particularly those of larger capacity, this minimum operational height may be as much as approximately one meter forty centimeters.

The maintenance height is the height at which the floating roof has to be held when in maintenance mode, in order to enable workmen to enter inside the tank to carry out maintenance operations. This is higher than the minimum operational height.

SUMMARY OF THE INVENTION

The present invention provides an improvement for product-storage tanks which solves the problems described above, saves time and reduces operating costs.

The heating system of the invention is defined in claim 1. The invention also provides a liquid storage tank including such a heating system.

Use is made of a system of principally radial tubes along which the flow of a heating fluid, preferably steam, may be convergent (towards the centre) or divergent (towards the periphery). All the tubes carry heating-fluids and connect a central, inner arc to an outer arc. Each arc may itself form a ring, or there may be a succession of arcs which may or may not form a complete ring. An analogy may be made between the assembly and a wheel, in which the wheel rim corresponds to the outer ring (periphery) and the wheel hub corresponds to the inner ring. The wheel spokes correspond to the radial tubes. In this way, the system comprises a first tube which is substantially in the form of an outer arc and second tube which is substantially in the form of an inner arc, both interconnected by principal radial tubes from which emerge a plurality of branches which then also assume a radial geometry, forming secondary radial tubes which extend as far as the said outer arc. The system is supported by means of supports which are fastened to the tubes and only rest without being fastened, for example, welded, on the floor of the tank. Most of the tubes of the system slope downwards, which prevents the formation of water hammer and which (as will be described below) may save energy.

The floor of the tank preferably has its centre at a level which is below the level of the edges. In this way, the residues which it is desired to drain off concentrate in a central region of the bottom. Use is also made in this case of a ramp-type drainage channel which starts from the centre of the bottom of the tank and runs towards the edges. This ramp slopes sufficiently to enhance the draining-off of the undesirable materials to the outside of the tank.

However, the present invention may instead be used in tank floors with drainage at the periphery of the tank, in order to provide this type of tank with a heating system.

BRIEF DESCRIPTION OF THE DRAWINGS

The characteristics of the present invention will be better understood on the basis of the detailed description which will be given hereinbelow, purely by way of example, in combination with the drawings mentioned below which are an integral part of the present specification and in which.

DETAILED DESCRIPTION OF THE INVENTION

Figure 1:
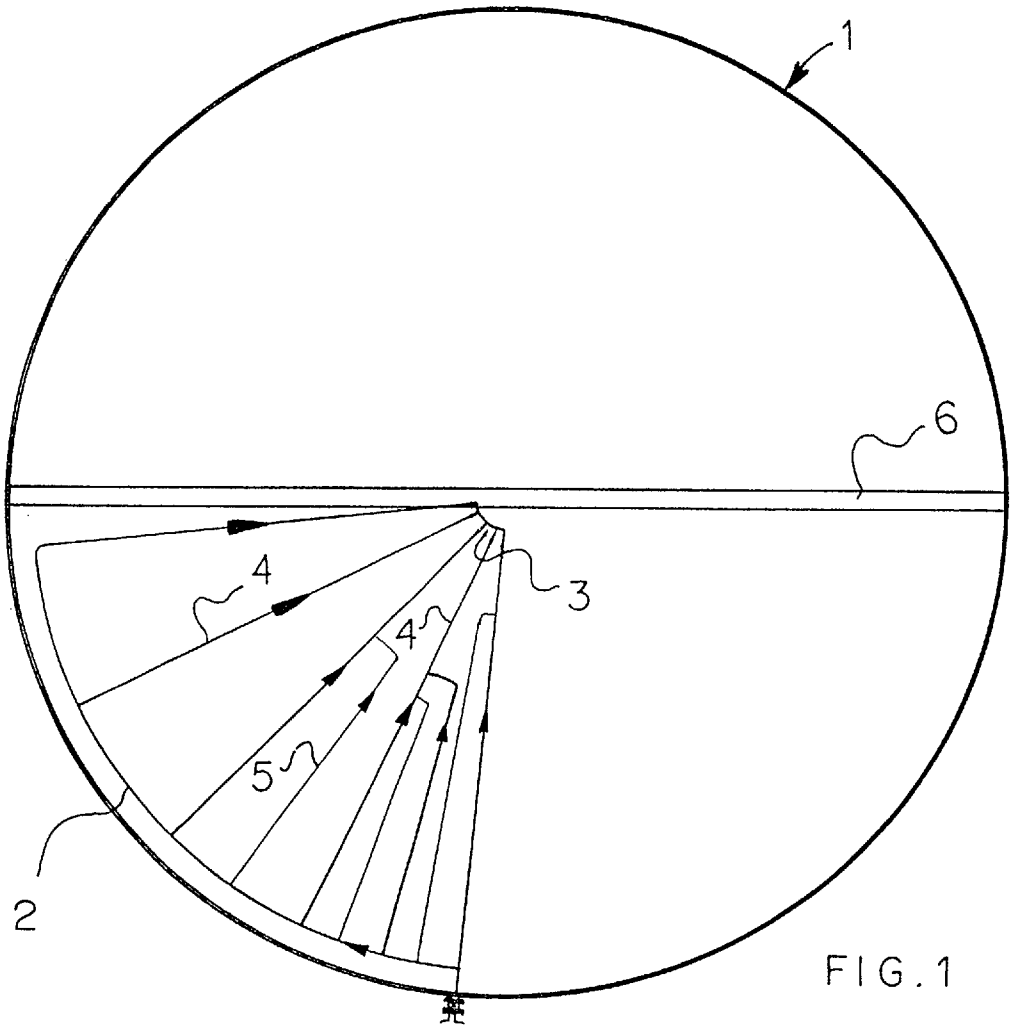
FIG. 1 is a plan view of the segmented, radial-type heating system for a product-storage tank with an inverted (upwardly convex) floor, as in PCT/BR97/00022, and it shows one of the embodiments of the present invention.

The heating systems shown in the drawings use, as the heating medium, steam which may or may not be superheated.

FIG. 1 shows a storage tank 1 with the heating system of the present invention. The circumference represents the side wall of the tank and the circle the perimeter of the floor of the tank. There is a first arcuate tube 2 which is substantially in the form of an outer arc and constitutes an outer ring section (serving as a hot heating fluid or steam distributor) via which the heating fluid or steam enters, and a second arcuate tube 3 which is substantially in the form of an inner arc and constitutes an inner ring section (cold heating fluid or condensate receiving device) via which the steam exits. The heating system illustrated covers slightly less than one quarter of the area of the floor of the tank.

Five principal radial tubes 4 may be seen. FIG. 1 also shows four secondary radial tubes 5, each connected by means of a small tube segment at an intermediate point on a respective principal radial tube, these points preferably being closer to the arc of the inner tube 3 than to the arc of the outer tube 2. There is also at least one small channel 6 in the tank floor, which is a drainage channel for draining off the liquid products from the tank, this small channel does not form part of the present invention. Each such small channel 6 runs from the centre of the tank floor to the edge of the tank, and has a slope which allows draining-off to take place.

Figure 2:
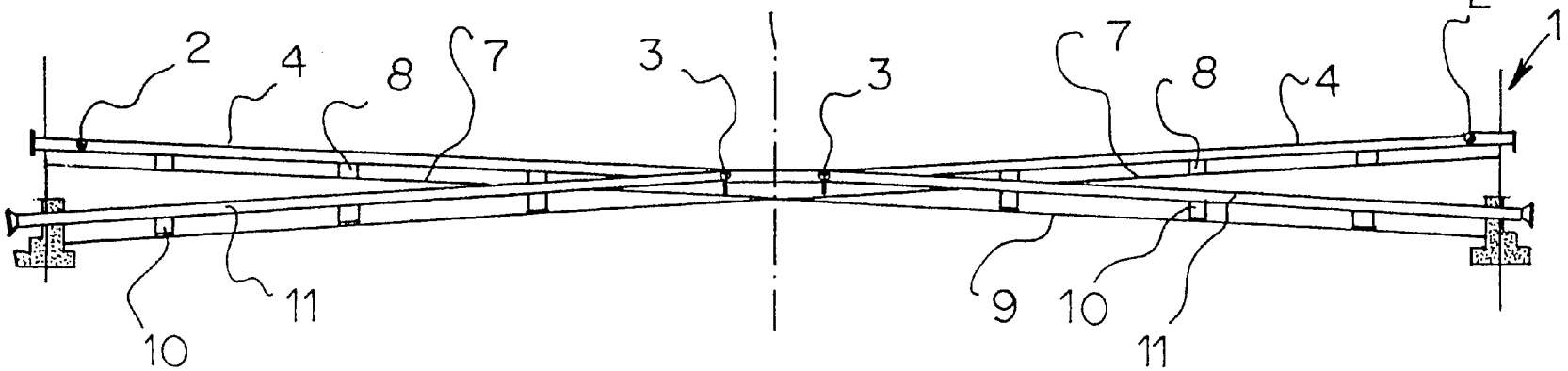
FIG. 2 is a side view of the heating system, also for a petroleum-storage tank, with an inverted bottom, and it shows a second embodiment of the present invention.

FIG. 2 shows a side view of a second embodiment of the present invention, in which the radial tubes here cover more than one quarter (almost a semi-circle) of the circular area of the tank. This embodiment also applies to a storage tank with an inverted (upwardly conical) floor, like that in FIG. 1. The supports 8 of the tubes 4 and 5 are on the floor 7 of the tank. It can be seen that this Figure does not show the secondary radial tubes 5. The supports 8 have substantially equal lengths, which means that the tubes 4 and 5 maintain the same vertical distance from the tank floor 7. The slope of the tank floor 7 is sufficient to enhance the draining-off of the undesirable liquids from the edges of the tank towards the centre of the tank. FIG. 2 also shows the floor 9 of a radially extending drainage channel in the tank floor 7 in which are located, by means of supports 10, the outlet tubes 11 for the heater system condensate. The top of each support 8, 10 is fastened to a respective tube 4, 11 and the bottom of the support rests freely on the tank floor 7 or the channel floor 9, respectively. Each support may be a chamfer notched block welded to the tube.

Figure 3:
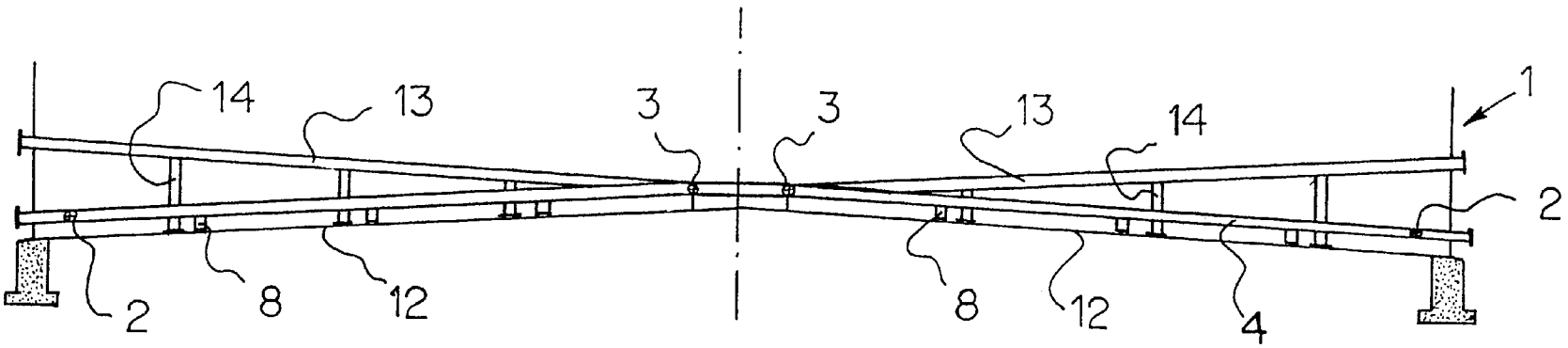
FIG. 3 is a side view of the heating system for another petroleum-storage tank, but one with a conventional bottom, and it shows a third embodiment of the present invention.

FIG. 3 shows a third embodiment of the present invention, applied to a storage tank with a conventional floor (edges lower than the centre). The heating system is mounted on the floor 12 of the tank, as low as possible and fastened only to the supports 8, which substantially have equal lengths. This fastening is achieved in the same way as in the embodiment of FIG. 2. However, in contrast to the case of the inverted floor, there is at least one substantially radial inlet tube 13 via which the heating steam enters. This inlet tube, like others of this type, is supported by supports 14 having lengths which decrease the closer they are to the centre of the tank. The slope of the tank floor 12 is sufficient to enhance the draining-off of the undesirable liquids from the centre to the edges of the storage tank 1.

Depending on the type of bottom, inverted or conventional, the inner arc is the receiving device or the distributor, i.e. the steam may enter via the outer arc tube 2 or via the inner arc tube 3. In any case, the principal radial tubes 4, the secondary radial tubes 5, the inlet tubes 13 and the outlet tubes 11 all slope downwards, in relation to the slope of the floor of the tank. The non-sloping part of the system is only in the rings 2 and 3 and in the non-radial branching section connecting to the secondary tubes 5 and is, however, quite short. The flow of steam in the system will then always be descending, and will facilitate the exit of condensate. Consequently, the system will not have accumulations of condensate which would promote water hammer. If there is no hammer phenomenon, it is possible to take advantage of part of the energy of the condensate using a thermostatic controller instead of a condensate drain valve in the heater discharge. This may represent an energy saving of more than 10%, depending on the characteristics of the steam used (e.g. degree of superheating) which is an important advantage of the present invention.

The number of radial tubes may vary as a function of the space in the bottom of the tank. FIG. 1 shows the respective tubes 2 and 3 of the outer and inner arc sections, and also shows radial tubes occupying almost one quarter of the circle of the tank, i.e. occupying only a sector of the circle. In FIG. 1 these tubes 2 and 3 are arcuate, but they could be of another shape, e.g. polygonal, in plan view.

The system may or may not be segmented. If it is segmented, there are various independent sectors, each constituting an individual heater. If not, the rings are unbroken. Both possibilities are within the scope of the invention. Discharge of condensate may be concentrated in a tube of larger diameter. Therefore, for example in FIG. 2, the diameter of tube 2 at the periphery may be 4" and that of tube 3 at the centre may be 6". In FIG. 3 these preferred values are reversed, i.e. tube 2 is larger than tube 3. The arrangement of the secondary radial tubes 5 of FIG. 1 makes it possible to take full advantage of the surface area of the tank floor, ensuring that the heating is distributed evenly at all positions on the tank floor.

The difference in level which exists between the centre of the bottom of the storage tank and the edges aims to facilitate movement of the undesirable liquids towards the lowest part of the storage tank floor. It is an advantage of the present invention that the majority of the heating tubes used in it are radial, i.e. they run in the same direction as the direction of movement of the undesirable material, and therefore there are no major obstacles to such movement. In the case of coils, a part of the tubes would always be transverse to the path where the undesirable material is moving, and that movement would be made difficult.

A further advantage of the present invention is the enormous heating capacity of the radial system in comparison with the coil form, since the radial tubes can be very close to one another. It is also possible to heat the tank in blocks, instead of having to heat the entire tank. This therefore makes it possible to prevent the exit of condensate at high temperatures. The condensate may exit at controlled temperatures, which saves energy.

What is claimed is:

1. A heating system for a tank for storing liquid products comprising:

at least one outer arcuate tube disposed in a vicinity of a side wall of said tank so as to define an outer arc, said at least one outer arcuate tube serving as a hot heating fluid distributor for receiving hot heating fluid from at least one inlet tube and distributing said hot heating fluid;

at least one inner arcuate tube disposed in a vicinity of a center of a floor of said tank so as to define an inner arc, said at least one inner arcuate tube serving as a cold heating fluid receiving device for receiving cooled heating fluid and directing said cold heating fluid to exit through at least one outlet tube;

a plurality of principal radial tubes connecting said at least one outer arcuate tube to said at least one inner arcuate tube;

a plurality of secondary radial tubes, each of said secondary radial tubes connecting a respective outer arcuate tube of said at least one outer arcuate tube to an intermediate point of a respective principal radial tube of said plurality of principal radial tubes, said intermediate point being closer to said at least one inner arcuate tube than to said at least one outer arcuate tube; and a plurality of supports for supporting said at least one outer arcuate tube, said at least one inner arcuate tube, said plurality of principal radial tubes and said plurality of secondary radial tubes on the floor of said tank, each support of said plurality of supports having substantially equal length so as to substantially maintain each of said at least one outer arcuate tube, said at least one inner arcuate tube, said plurality of principal radial tubes and said plurality of secondary radial tubes at a same vertical distance from said floor of said tank.

2. A heating system as recited in claim 1, wherein said outer and inner arcuate tubes occupy at least one sector of a circle formed by the floor of said tank.

3. A heating system as recited in claim 1, wherein the center of the floor of said tank is located at a level which is below a level of a peripheral edge of the floor, a drainage channel being defined in the floor to extend outwardly from the center of the floor to the edge of the floor.

4. A heating system as recited in claim 3, wherein said outer and inner arcuate tubes occupy at least one sector of a circle formed by the floor of the tank.

5. A heating system as recited in claim 3, wherein said at least one outlet tube rests on a plurality of outlet tube supports which rest on a bottom wall of said drainage channel.

6. A heating system for a tank for storing liquid products comprising:

at least one inner arcuate tube disposed in a vicinity of a center of a floor of said tank so as to define an inner arc, said at least one inner arcuate tube serving as a hot heating fluid distributor for receiving hot heating fluid from at least one essentially radial inlet tube and for distributing said hot heating fluid;

at least one outer arcuate tube disposed in a vicinity of a side wall of said tank so as to define an outer arc, said at least one outer arcuate tube serving as a cold heating fluid receiving device for receiving cold heating fluid and directing said cold heating fluid to exit through at least one outlet tube a plurality of principal radial tubes connecting said at least one outer arcuate tube to said at least one inner arcuate tube;

a plurality of secondary radial tubes, each of said plurality of secondary radial tubes connecting a respective said at least one outer arcuate tube to an intermediate point of a respective principal radial tube of said plurality of principal radial tubes, said intermediate point being closer to said at least one inner arcuate tube than to said at least one outer arcuate tube; and a plurality of supports for supporting said at least one outer arcuate tube, said at least one inner arcuate tube, said plurality of principal radial tubes and said plurality of secondary radial tubes on a floor of said tank for storing liquid products, each support of said plurality of supports having a substantially equal length so as to substantially maintain each of said at least one outer arcuate tube, said at least one inner arcuate tube, said plurality of principal radial tubes and said plurality of secondary radial tubes at a same vertical distance from said floor of said tank.

7. A heating system as recited in claim 6, wherein said outer and inner arcuate tubes occupy at least one sector of a circle formed by the floor of said tank.

8. A heating system for a tank for storing liquid products, comprising:

a first arcuate tube substantially extending over a first arc;

a second arcuate tube substantially extending over a second arc;

a plurality of principal radial tubes fluidly connecting said first arcuate tube and said second arcuate tube, each of said principal radial tubes having a radially inner end and a radially outer end, said second arcuate tube being coupled to said radially inner ends of said principal radial tubes and said first arcuate tube being connected to said radially outer ends of said principal radial tubes so that said first tube defines a radially outer arc and said second tube defines a radially inner arc;

a plurality of branches extending from an intermediate part of said principal radial tubes and assuming a radial direction so as to define a plurality of secondary radial tubes, each of said secondary radial tubes being connected to said first arcuate tube; and a plurality of supports fastened to said first arcuate tube, said second arcuate tube, said plurality of principal radial tubes and said plurality of secondary radial tubes for supporting said tubes on a floor.

9. A heating system as recited in claim 8, wherein said intermediate part of said principal radial tubes is closer to said second arcuate tube than to said first arcuate tube.

10. A heating system as recited in claim 8 in combination with and disposed within a tank for storing liquid products, said tank having a floor and a side wall that is generally circular in cross-section, said first arcuate tube being disposed in a vicinity of the side wall of said tank, and said second arcuate tube being disposed in a vicinity of a center of the floor of said tank.

11. The combination as recited in claim 10, wherein the center of the floor of said tank is located at a level which is below a level of a peripheral edge of the floor, a drainage channel being defined in the floor to extend outwardly from the center of the floor to the edge of the floor.

12. The combination as recited in claim 10, wherein each support of said plurality of supports has a substantially equal length so as to substantially maintain each of said first arcuate tube, said second arcuate tube, said plurality of principal radial tubes and said plurality of secondary radial tubes at a same vertical distance from said floor of said tank.

* * * * *